United States Patent [19]

Umeda et al.

[11] 4,185,930

[45] Jan. 29, 1980

[54] PRINT POSITION CONTROL IN A PRINTER INCLUDING A PRINTER HEAD MOUNTED ON A TRAVELING CARRIAGE

[75] Inventors: Ikuo Umeda; Masahiko Aiba, both of Nara; Kozo Kimura, Yamatokoriyama, all of Japan

[73] Assignee: Sharp Kabushiki Kaisha, Japan

[21] Appl. No.: 918,419

[22] Filed: Jun. 23, 1978

[30] Foreign Application Priority Data

Jun. 27, 1977 [JP] Japan ..... 52-76753

[51] Int. Cl.[2] ..... B41J 19/30; B41J 25/22

[52] U.S. Cl. ..... 400/320; 400/322; 400/328

[58] Field of Search ..... 400/53, 121, 124, 126, 400/320, 322, 323, 328, 344, 355; 101/93.15, 93.16, 93.17; 346/139 B

[56] References Cited

U.S. PATENT DOCUMENTS

| | | | |
|---|---|---|---|
| 4,034,842 | 7/1977 | Giacone | 400/322 X |
| 4,044,882 | 8/1977 | Weinke et al. | 400/320 X |
| 4,050,564 | 9/1977 | Carmichael et al. | 400/320 X |
| 4,076,111 | 2/1978 | Robinson et al. | 400/322 X |
| 4,118,129 | 10/1978 | Grundherr | 400/320 X |
| 4,143,980 | 3/1979 | Giebler et al. | 400/320 X |

*Primary Examiner*—Paul T. Sewell

*Attorney, Agent, or Firm*—Birch, Stewart, Kolasch & Birch

[57] ABSTRACT

A printer head is mounted on a carriage which is driven to travel in the row direction at a predetermined constant speed. A pulse generation device is provided for developing a pulse signal in response to the travel of the carriage in order to determine print width. A detection device develops a detection signal when the carriage reaches the first print position to initiate printing of the first character. The detection signal is applied to a counter which counts a time interval from a time at which the last pulse is developed from the pulse generation device to a time at which the detection signal is developed. The following character printing is effected each time the pulse generation device develops a predetermined number of pulses indicative of one character width or print pitch and the time interval determined by the counter has passed from the time at which the last pulse of the predetermined number is developed.

5 Claims, 5 Drawing Figures n-th ROW (n+1)-th ROW

PRINT POSITION CONTROL IN A PRINTER INCLUDING A PRINTER HEAD MOUNTED ON A TRAVELING CARRIAGE

BACKGROUND AND SUMMARY OF THE INVENTION

The present invention relates to a print position control system in a printer including a printer head mounted on a traveling carriage and, more particularly, to a print position control system in a serial printer such as an ink jet system printer of the charge amplitude controlling type.

Generally, in a serial printer such as an ink jet system printer of the charge amplitude controlling type, a pulse signal generation means is associated with a drive mechanism of a carriage for developing a pulse signal of a given frequency in response to travel of the carriage. The thus developed pulse signal is used for controlling the print position. Generation of the pulse signal must be strictly correlated with the location of the carriage in order to ensure accurate print position control.

However, it is very difficult to strictly correlate the location of the carriage with the generation of the pulse signal especially in a printer which includes a reciprocating carriage. Deviation of the relationship between the carriage position and the pulse generation is mainly caused by a slip occurring within the drive mechanism of the carriage.

Accordingly, an object of the present invention is to provide a print position control system for a printer including a printer head mounted on a traveling carriage.

Another object of the present invention is to provide a print position control system for a serial printer, which ensures accurate print position control.

Still another object of the present invention is to provide a compensation means for compensating for the deviation of the print position in a serial printer.

Yet another object of the present invention is to simplify a drive mechanism of a carriage in a serial printer.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, a pulse generation means is provided for developing a pulse signal in response to travel of the carriage in order to determine one character width or a print pitch.

The pulse generation means comprises a slit plate mounted on a motor shaft for developing a slit pulse signal in response to rotation of a motor which drives the carriage. A first counter means is connected to receive the slit pulse signal derived from the pulse generation means and develops a first control signal when the first counter means counts a predetermined number of pulses. The predetermined number is indicative of the one character width or the print pitch.

A detection means is associated with a guide rail of the carriage for developing a detection signal when the carriage reaches the first print position of one row in order to initiate printing of the first character. A second counter means is connected to receive the slit pulse signal and the detection signal for counting a time interval from a time at which the last pulse is developed from the pulse generation means to a time at which the detection signal is developed.

The following character printing is effected each time the first control signal is developed from the first counter means and the time interval determined by the second counter means has passed from the generation of the first control signal.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENTS

Figure 1:
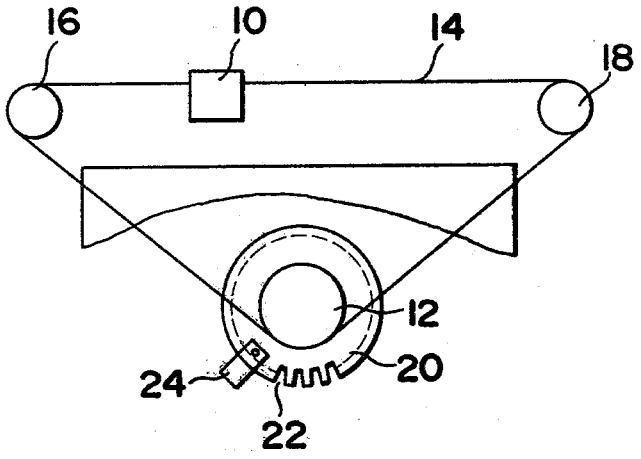
FIG. 1 PRIOR ART
FIG. 1 is a schematic plan view of a carriage drive mechanism of the prior art.

Referring now in detail to the drawings, and to facilitate a more complete understanding of the present invention, a carriage drive mechanism of the prior art will be first described with reference to FIG. 1.

A printer head is mounted on a carriage 10, which is driven to reciprocate in the row direction by a motor 12. Rotation of the motor 12 is transferred to the carriage 10 through the use of a wire 14 which extends among the motor 12 and pulleys 16 and 18. A slit plate 20 is mounted on a shaft of the motor 12. The slit plate 20 is provided with rectangular slits 22 aligned on the perphery of the slit plate 20. An optical slit sensor 24 is located at a position corresponding to the rectangular slits 22 for developing a pulse signal in response to the rotation of the slit plate 20.

That is, the slit sensor 24 develops the pulse signal in response to the travel of the carriage 10. The thus developed pulse signal is used as a timing signal for determining a print position. More specifically, one character width or a print pitch is determined by counting a predetermined number of pulses derived from the slit sensor 24.

In the above constructed carriage drive mechanism, it is strictly required that the rotation of the slit plate 20 corresponds to the travel of the carriage 10. The wire 14 is tightly extended amount the motor 12 and the pulleys 16 and 18. That is, the carriage 10 is driven directly by the motor 12.

However, there is a possibility that the relationship between the carriage 10 and the slit plate 20 is deviated while the carriage repeats the reciprocating travel. The present invention is to provide a print position control system which can compensate for the above-mentioned deviation.

Figure 2:
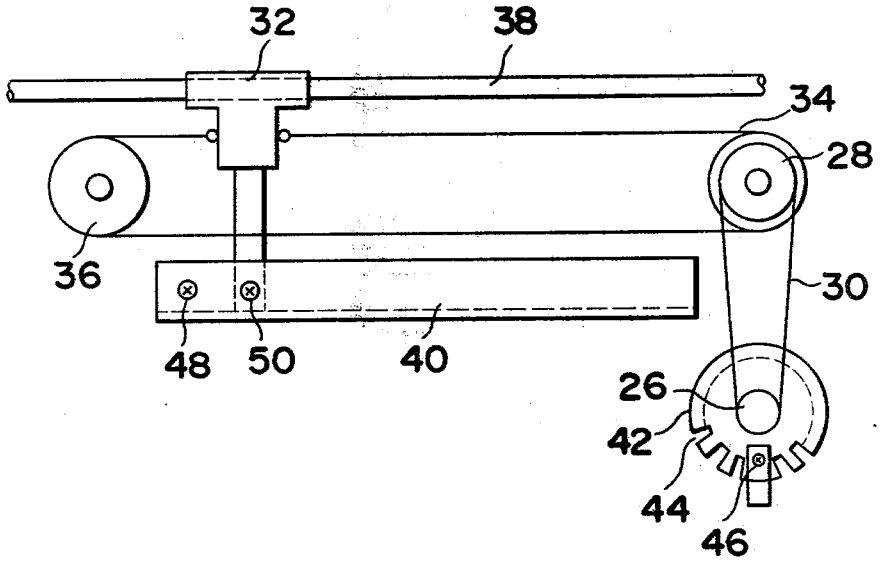
FIG. 2 is a schematic plan view of an embodiment of a carriage drive mechanism of the present invention.

FIG. 2 schematically shows an embodiment of a carriage drive mechanism of the present invention, which is applicable to an ink jet system printer of the charge amplitude controlling type.

A pulley 26 is mounted on a motor shaft for transmitting rotation of the motor to a head drive pulley 28 via a belt 30. A printer head is mounted on a carriage 32 which is driven to reciprocate in the row direction by a wire 34 extending between the head drive pulley 28 and an idler pulley 36. The carriage 32 is slidably mounted on a shaft 38. A guide rail 40 slidably supports one end of the carriage 32 to ensure the smooth travel of the carriage 32.

A slit plate 42 is mounted on the motor shaft. The slit plate 42 is provided with rectangular slits 44 aligned on the periphery of the slit plate 42. An optical slit sensor 46 is located at a position corresponding to the rectangular slits 44 for developing a pulse signal in response to the rotation of the slit plate 42. The thus developed pulse signal is used as a timing signal for determining a print position. More specifically, one character width or a print pitch is determined by counting a predetermined number of pulses derived from the slit sensor 46.

The carriage 32 is held stationary at the leftmost position when the ink jet system printer is placed in the standby condition. The location of the carriage 32 at the leftmost position is detected by a sensor 48 comprising a light-emitting element and a light-responsive element. When a print start command is generated, the motor begings to rotate in the forward direction and, therefore, the carriage 32 begins to travel forward.

When the carriage 32 reaches the first print position, a detection means 50 comprising a light-emitting element and a light-responsive element detects the arrival of the carriage 32. When the carriage 32 reaches the detection means 50, the traveling velocity of the carriage 32 has reached a predetermined fixed value.

In the drive system of the prior art, the first character print is conducted when a first slit pulse is developed from the slit sensor 46 after a detection signal is developed from the detection means 50. The following character printing is conducted each time the slit sensor 46 develops a predetermined number of pulses, for example, ten pulses.

When one row printing is completed, the carriage 32 is driven to travel backward toward the leftmost position and, then, the following row printing is conducted. At this moment, there is a possibility that the relationship between the carriage position and the slit plate rotation is deviated due to a slip occurring within the drive mechanism. Therefore, in the drive mechanism of the prior art, there is a possibility that the print position is different from each other at different rows.

To eliminate the above-mentioned variation of the print position, in accordance with an embodiment of the present invention, the first character printing is effected when the detection means 50 develops the detection signal. A counter means is provided for counting a time interval from a time at which the last slit pulse is developed from the slit sensor 46 to a time at which the detection signal is developed from the detection means 50. The thus obtained time interval corresponds to the deviation of the relationship between the carriage position and the slit plate rotation. And, the thus obtained time interval is used as a compensation value for compensating for the deviation of the slit pulse generation timing.

Figure 3:
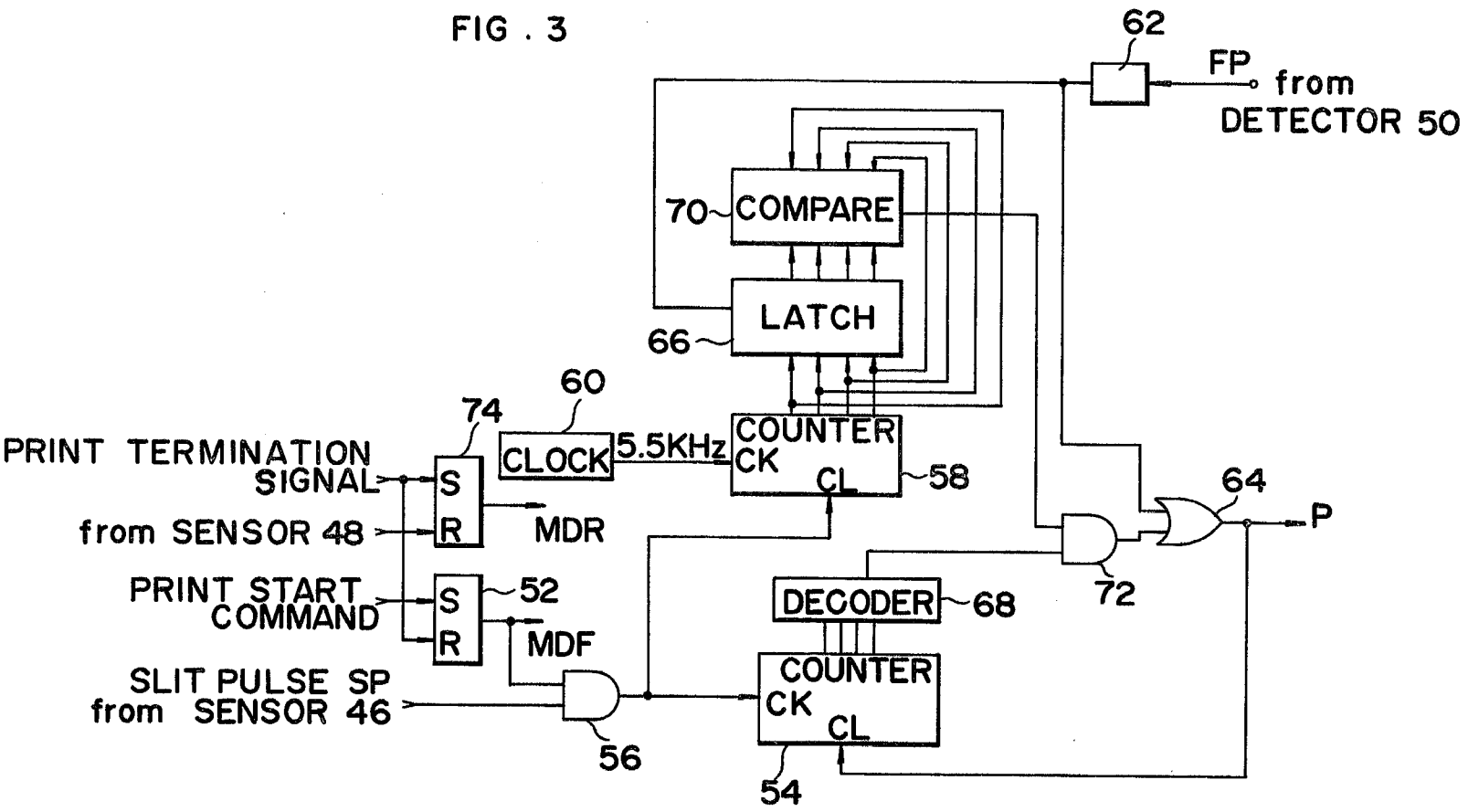
FIG. 3 is a block diagram of an embodiment of a print position control system of the present invention.
Figure 4:
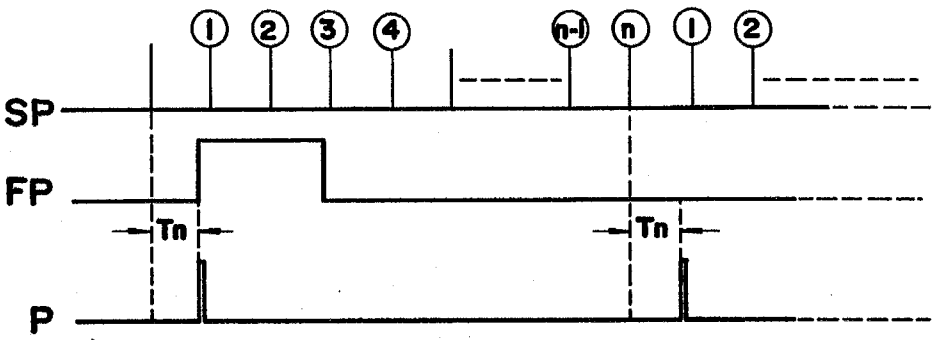
FIGS. 4(A) and 4(B) are time charts showing various signals occurring within the print position control system of FIG. 3.
Figure 4:
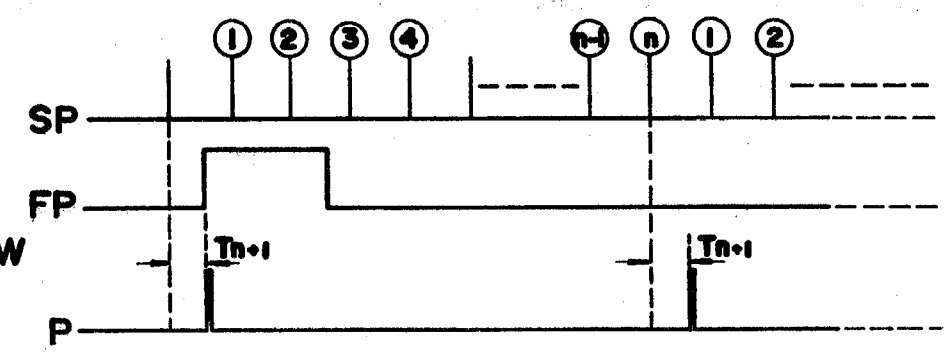

FIG. 3 shows an embodiment of a print position control system of the present invention. FIGS. 4(A) andd 4(B) show various signals occurring within the print position control system of FIG. 3.

Now assume that the n-th row is desired to be printed. When the print start command is developed, a flip-flop 52 is set to develop a motor forward drive signal MDF. The motor begins to rotate forward, and the carriage 32 is driven to travel forward. In synchronization with the rotation of the motor, the slit sensor 46 develops a slit pulse SP as shown in FIG. 4(A). When the motor reaches the constant rotation speed, the slit pulse SP has a pulse interval of 20 msec.

The slit pulse SP is applied to a first counter 54 through an AND gate 56. The first counter 54 counts the number of slit pulse SP. The slit pulse SP is also applied to a clear input of a second counter 58 through the AND gate 56. The second counter 58 is connected to receive a reference frequency signal of, for example, 5.5 KHz developed from a clock signal generator 60 in order to count a time interval initiated by the occurrence of the last slit pulse SP.

When the carriage 32 reaches the first print position, the detection means 50 develops a first print position signal FP as shown in FIG. 4(A). The first print position signal FP is applied to a waveform shaping circuit 62, which shapes the first print position signal FP and develops an output signal in response to a leading edge of the first print position signal FP.

The output signal of the waveform shaping circuit 62 is applied to an OR gate 64, which develops a print command P for effecting one character print as shown in FIG. 4(A). The output signal of the waveform shaping circuit 62 is also applied to a latch circuit 66, which functions to store the contents of the second counter 58 upon receiving the output signal from the waveform shaping circuit 62. In addition, the print command P developed from the OR gate 64 is applied to the clear terminal of the first counter 54 to clear the contents stored in the first counter 54.

Accordingly, the latch circuit 66 stores time interval information Tn corresponding to time interval from the last occurrence of the slit pulse SP to the leading edge of the first print position signal FP.

When the first counter 54 counts a predetermined number of slit pulses SP, for example, by n, a decoder 68 develops an output signal. A comparing circuit 70 compares the contents stored in the second counter 58 and the latch circuit 66. The comparing circuit 70 develops an output signal each time the counted number stored in the second counter 58 reaches the contents stored in the latch circuit 66.

The output signals of the decoder 68 and the comparing circuit 70 are applied to an AND gate 72, which develops the print command P through the OR gate 64. More specifically, the print command P is developed each time the first counter 54 counts the slit pulse SP by n and the time interval Tn has passed from the occurrence of the n-th slit pulse. The first counter 54 is cleared by the print command P.

The above-mentioned operation is repeated till one row printing is completed. When one row printing is completed, a print termination signal is developed in a conventional manner. The thus developed print termination signal is applied to the reset terminal of the flip-flop 52 for terminating the forward rotation of the motor, and to the set terminal of a flip-flop 74 for initiating the reverse rotation of the motor. That is, the flip-flop 74 develops a motor reverse drive signal MDR upon receiving the print termination signal. Generation of the motor reverse drive signal MDR is terminated when the sensor 48 detects that the carriage 32 is returned to the leftmost position.

When the slip occurs within the drive mechanism during the reverse drive of the carriage 32, the (n+1)-th row printing is conducted in a way shown in FIG. 4(B).

That is, for the (n+1)-th row printing, the latch circuit 66 stores time interval information $T_{n+1}$. The first character printing is also conducted upon receiving the first print position signal FP.

As discussed above, the print position control system of the present invention can compensate for the deviation of the carriage position with respect to the slit plate rotation. Therefore, the correspondence between the carriage position and the motor rotation is not so strictly required as the drive mechanism of the prior art. Accordingly, the drive mechanism can be simplified.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A print position control system for a printer including a printer head mounted on a carriage, and a drive mechanism for driving said carriage at a fixed speed in a row direction, said print position control system comprising:

a pulse generation means for developing pulse signals in response to travel of said carriage;

a first counter means for counting said pulse signals developed from said pulse generation means;

means for developing a first control signal each time said first counter means counts a predetermined number of pulse signals;

detection means for developing a first character print command signal when said carriage reaches the first character print position;

a second counter means for counting pulses indicative of a time interval from a time at which the last pulse signal is developed from said pulse generation means to a time at which the first character print command signal is developed from the detection means; and means for developing print commands each time said time interval has passed after generation of said first control signal.

2. The print position control system of claim 1, wherein said first counter means is cleared by said print commands.

3. The print position control system of claim 1, which further comprises a reference frequency signal generator for developing a reference frequency signal to said second counter means in order to count said time interval.

4. The print position control system of claim 1, 2 or 3, wherein said drive mechanism comprises a motor, and said pulse generation means comprises a slit plate mounted on a shaft of said motor and a slit sensor for developing said pulse signals in response to rotation of said slit plate.

5. The print position control system of claim 4, wherein said first control signal is developed with a time interval corresponding to one character width.

* * * * *